US006139008A

United States Patent [19]

Margiotta

[11] Patent Number: 6,139,008

[45] Date of Patent: Oct. 31, 2000

[54] CURL ELIMINATOR FOR ELIMINATING A CURL FROM PAPER TO BE PRINTED BY A PRINTER

[75] Inventor: Al Margiotta, Plainview, N.Y.

[73] Assignee: Olympus America, Inc., Melville, N.Y.

[21] Appl. No.: 09/193,359

[22] Filed: Nov. 17, 1998

[51] Int. Cl.[7] ..... B65H 1/08

[52] U.S. Cl. ..... 271/148; 271/209; 271/161; 271/147; 493/412

[58] Field of Search ..... 271/209, 148, 271/161, 147; 493/412

[56] References Cited

U.S. PATENT DOCUMENTS

| | | | |
|---|---|---|---|
| 1,685,799 | 10/1928 | Baker | 271/147 X |
| 4,631,552 | 12/1986 | Kobayashi | 400/613.2 X |
| 4,941,654 | 7/1990 | Kelley | 271/209 |
| 5,074,837 | 12/1991 | Blanton, III et al. | 493/412 |
| 5,295,676 | 3/1994 | Kenin et al. | 271/94 |
| 5,348,284 | 9/1994 | Ishihama et al. | 271/160 |
| 5,386,982 | 2/1995 | Kawano | 271/10 |
| 5,605,528 | 2/1997 | Larson | 493/411 |
| 5,734,404 | 3/1998 | Komuro et al. | 347/104 |

FOREIGN PATENT DOCUMENTS

| | | | |
|---|---|---|---|
| 63-185747 | 8/1988 | Japan | 271/161 |
| 64969 | 3/1989 | Japan | 271/209 |
| 100225 | 4/1994 | Japan | 271/209 |
| 156853 | 6/1994 | Japan | 271/209 |

OTHER PUBLICATIONS

Popular Mechanics, Sponge Rubber on Feed Board of Press Aids Printer, vol. 75, No. 1, p. 146, Jan. 1941.

*Primary Examiner*—Christopher P. Ellis
*Assistant Examiner*—Richard Ridley
*Attorney, Agent, or Firm*—Scully, Scott, Murphy & Presser

[57] ABSTRACT

A curl eliminator for eliminating a curl from paper to be printed by a printer. The printer has a paper feeder including a paper tray for storage of the paper on a ferric top surface of the paper tray and for feeding the paper into the printer for subsequent printing. The curl eliminator has an elongated strip disposed at the top surface of the paper tray such that it opposes the curl of the paper thereby tending to flatten the curl. The curl eliminator also has a magnetic strip fastened to the elongated strip for mounting the elongated strip to the top surface of the paper tray. The elongated strip is mounted to the top surface of the paper tray by a magnetic attraction between the magnetic strip and the top surface of the paper tray. Also provided are a paper tray and printer having the curl eliminator of the present invention.

12 Claims, 3 Drawing Sheets

CURL ELIMINATOR FOR ELIMINATING A CURL FROM PAPER TO BE PRINTED BY A PRINTER

BACKGROUND OF THE INVENTION

1. Field of the Invention

The field of art to which this invention relates is-printers, in particular, a curl-eliminator for a high volume printer having a top-feeder in which pre-printed stock is being feed into the printer for further printing.

2. Description of the Related Art

In printers of the prior art, particularly those which employ a top-feeder for storing and feeding paper into the printer, paper which is curled (i.e., has a smile) presents a problem in that it does not properly feed into the printer. Printing on paper that is pre-printed, such as forms or checks, is particularly troublesome because of the pre-printed paper's tendency to curl.

A typical printer 100 of the prior art having such a top-feeder paper feed arrangement is shown in FIG. 1. The top-feeder 102 generally includes a paper tray 103 and employs a pick roller 104 for contacting and feeding a sheet of paper 106 from the top of a paper stack 108 into the printer 100. A gearbox and motor assembly 110 drive the pinch roller as necessary to feed the paper 108. If the paper in the paper stack 108 is curled, as is shown in FIG. 1, the pick roller 104, which is generally located in the center of the paper along a central axis C—C, does not efficiently engage and feed the paper 108 into the printer 100.

Furthermore, since the paper 108 is curled upward, its ends 108*a*, 108*b* are elevated over its center 108*c*, resulting in at least one of the ends 108*a* striking unintended parts of the feeder, such as the gearbox and motor assembly 110. This causes the top sheet of paper 106 to rotate while feeding into the printer 100, resulting in improper feeding and a subsequent paper jam.

Devices are known in the prior art for the reduction and/or elimination of paper curl. While these devices have their advantages, they are generally complex and costly, such as that disclosed in U.S. Pat. No. 5,734,404 to Kumuro, et al. Their complexity and cost also make them difficult, if not impossible, to retrofit onto existing printers which do not have a curl elimination system. The prior art devices also do not account for a changing degree of paper curl, thus only reducing the curl in badly curled paper, not eliminating it.

For these reasons a curl eliminator is needed which is simple, inexpensive, easy to retrofit onto existing printers and accounts for the degree of paper curl in a stack of paper to be fed into a printer, particularly one which employs a top-feeder system.

SUMMARY OF THE INVENTION

Therefore, it is an object of the present invention to provide a simple curl eliminator for a printer.

It is a further object of the present invention to provide an inexpensive curl eliminator for a printer.

It is a further object of the present invention to provide a curl eliminator which is easily retrofitted onto existing printers.

It is still yet another object of the present invention to provide a curl eliminator for a printer which accounts for a changing degree of curl in the paper to be fed into the printer.

Accordingly, a printer tray for eliminating a curl from paper to be printed by a printer is provided. The printer having a paper feeder including the paper tray for storage of the paper on a top surface thereof and for feeding the paper into the printer for subsequent printing. The printer tray comprising a curl eliminator having a heightened portion disposed at the top surface of the paper tray and positioned such that it opposes the curl of the paper thereby tending to flatten the curl.

In a first embodiment of the printer tray of the present invention, the heightened portion comprises a stepped portion integral with the top surface of the paper tray.

In a second embodiment of the printer tray of the present invention, the heightened portion comprises an elongated strip.

In a third embodiment of the printer tray of the present invention, the heightened portion comprises an elongated strip and an adjustment means for adjusting the height of the elongated strip above the top surface of the paper tray.

Also provided are printers having the embodiments of the curl eliminator of the present invention.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENTS

Although this invention is applicable to numerous and various types of printers and paper, it has been found particularly useful in the environment of printers employing a top-feeder. Therefore, without limiting the applicability of the invention to top-feeder printers, the invention will be described in such environment.

Figure 2:
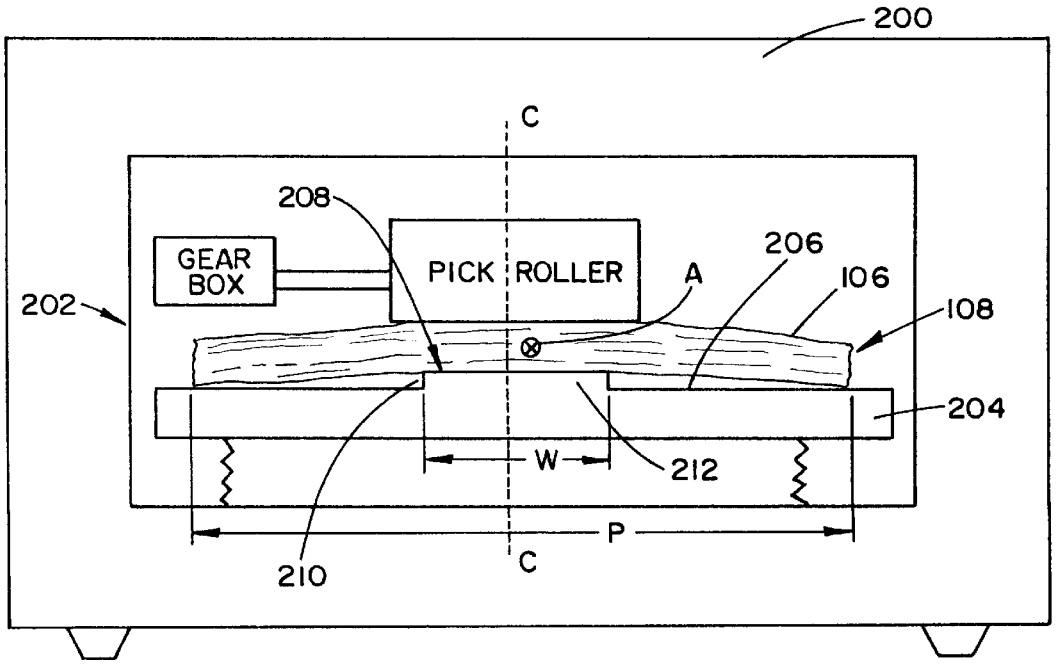
FIG. 2 is a side view from a front of a paper feeder having a first embodiment of the curl eliminator of the present invention and illustrating the flattening of the stack of curled paper to be printed thereupon.

Referring now in detail to FIG. 2, there is illustrated a printer 200. The printer 200 having a paper feeder 202 including a paper tray 204 for storage of a stack of paper 108 on a top surface 206 thereof and for feeding a top sheet 106 of the paper stack 108 into the printer 200 for subsequent printing.

The paper feeder 202 includes a curl eliminator 208 for eliminating a curl from the paper stack 108 to be printed by the printer 200. The curl eliminator 208 generally comprises a heightened portion 210 disposed at the top surface 206 of the paper tray 204 and positioned such that it opposes the curl of the paper stack 108 thereby tending to flatten the curl as shown in FIG. 2.

FIG. 2 shows a first embodiment of curl eliminator 208 of the present invention, wherein the heightened portion 210 comprises a stepped portion 212 integral with the top surface 206 of the paper tray 204. The stepped portion 212 is preferably positioned substantially along a central axis of the paper stack 108, wherein the central axis is parallel to the feeding direction of the paper (which is into the sheet in FIG. 2 as indicated by symbol A).

Figure 5:
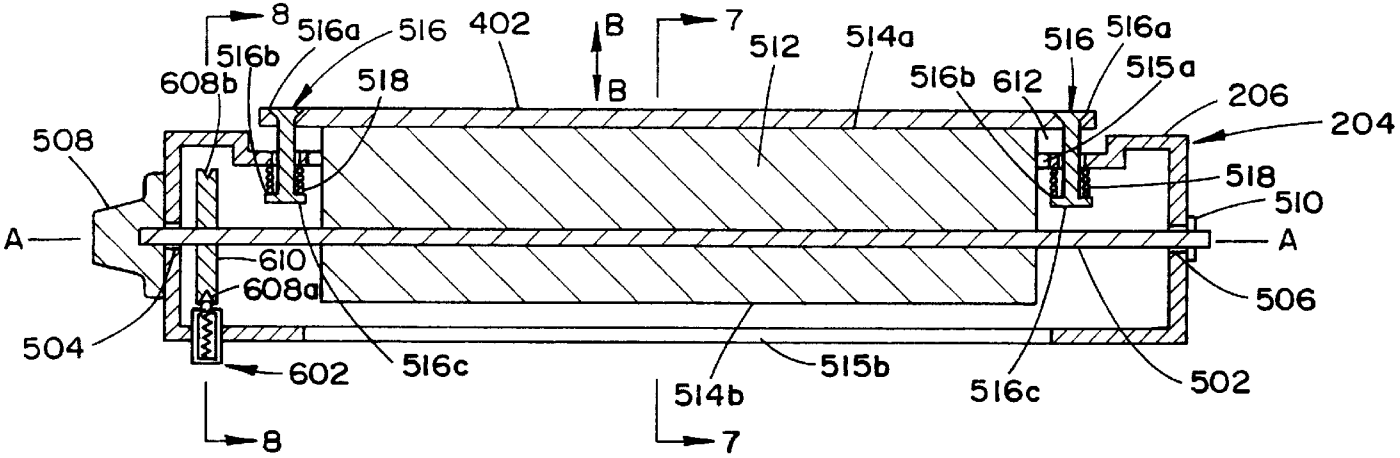
FIG. 5 is a sectional view of the curl eliminator of FIG. 4 taken along line 5—5 illustrating the elongated strip at a heightened position above the top surface of the paper tray.

Preferably the stepped portion has a length substantially equal to the length of the paper in the direction that the paper is fed into the printer (as is seen more clearly in the embodiment of FIG. 5). The width W of the stepped portion 212 is preferably between 0.5 and 2.0 inches if the width P of the paper fed into the printer 200 is 8.5 inches. At a paper width (P) of 8.5 inches, the width W of the stepped portion is most preferably 1.0 inch.

Figure 1:
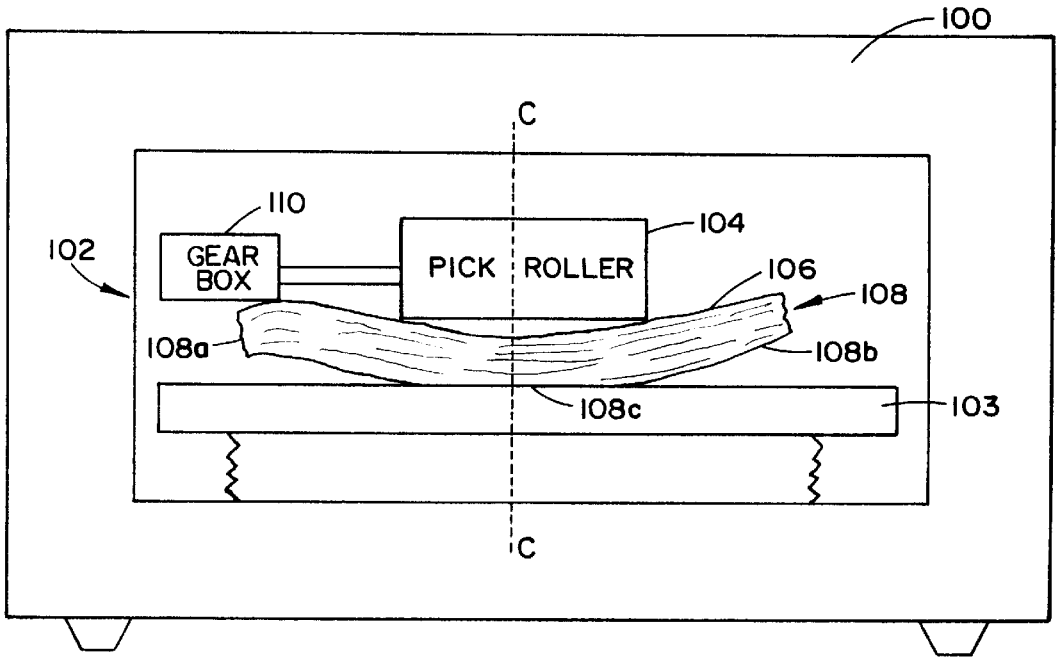
FIG. 1 (PRIOR ART)
FIG. 1 is a side view from a front of a paper feeder of the prior art illustrating the curl of a stack of paper to be printed thereupon.
Figure 3:
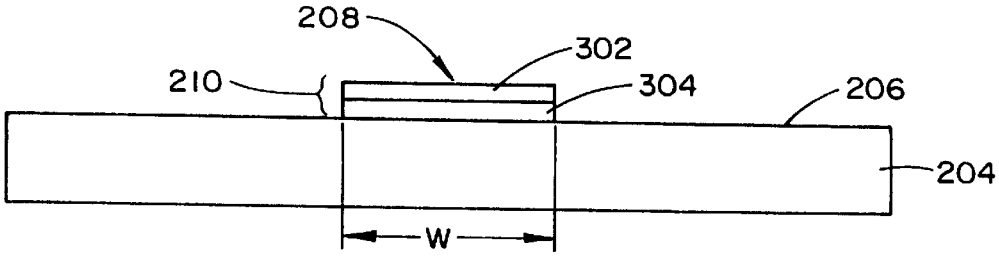
FIG. 3 is a side view of a second embodiment of a paper tray of the curl eliminator of the present invention.
Figure 4:
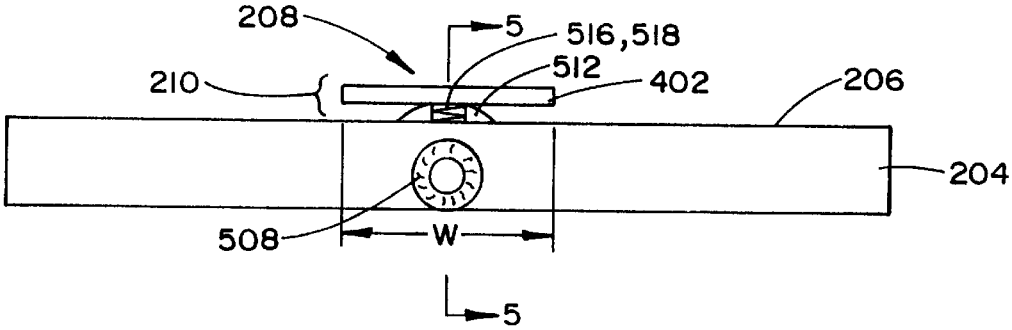
FIG. 4 is a side view of a third embodiment of a paper tray of the curl eliminator of the present invention.
Figure 7:
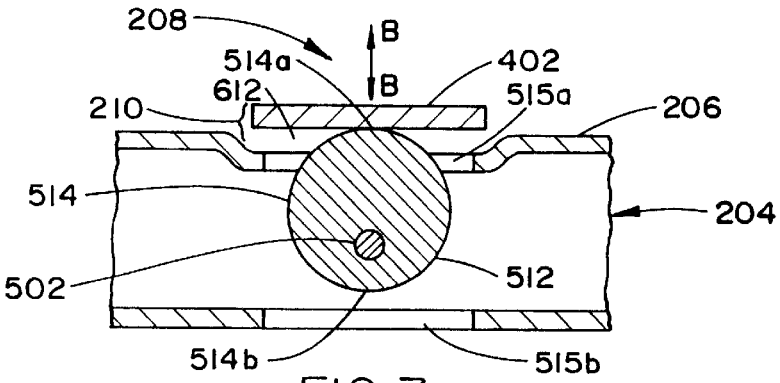
FIG. 7 is a partial sectional view of the curl eliminator of FIG. 5 taken along line 7—7.
Figure 8:
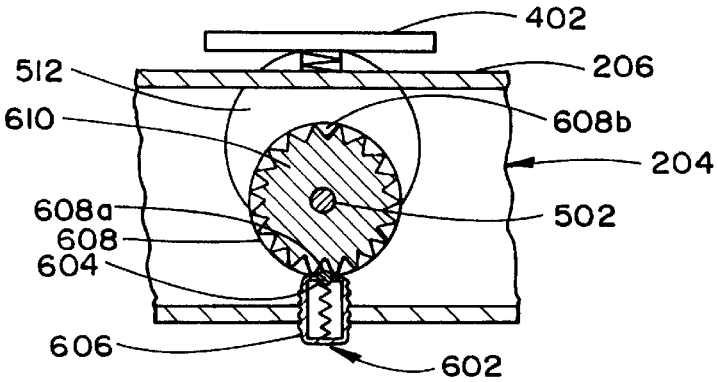
FIG. 8 is a partial sectional view of the locking means of the curl eliminator of FIG. 5 taken along line 8—8.

Referring now to FIG. 3, there is illustrated a second embodiment of the curl eliminator 208 of the present invention, wherein the heightened portion 210 comprises an elongated strip 302. The elongated strip 302 is positioned and sized as is the stepped portion of FIG. 1. However, the elongated strip 302 is not integral with the top surface 206 of the paper tray 204, but preferably lies on the top surface 206 and most preferably includes a mounting means for mounting the elongated strip 206 to the top surface 206 of the paper tray 204.

In a preferable configuration, the top surface 206 of the paper tray 204 is ferric, such as an iron containing steel, and the mounting means is a magnetic strip 304 fastened to the elongated strip 302. Thus, the elongated strip 302 is mounted to the top surface 206 of the paper tray 204 by a magnetic attraction between the magnetic strip 304 attached to the elongated strip 302 and the top surface 206 of the paper tray 204. Preferably, the magnetic strip 304 is fastened to the elongated strip 302 with a suitable adhesive. Alternatively, the elongated strip 302 and the mounting means can be integrated into a single strip which is magnetic.

Referring now to FIGS. 4–8, there is illustrated a third embodiment of the curl eliminator 208 of the present invention, wherein the heightened portion 210 comprises an elongated strip 402 and an adjustment means for adjusting the height of the elongated strip 402 above the top surface 206 of the paper tray 204.

The adjustment means preferably comprises a shaft 502 which is rotatably disposed in the paper tray 204 through openings 504, 506. The shaft 502 is retained in the openings 504, 506 at a first end with a knob 508, preferably press fit onto the shaft 502, and at a second end with a retaining ring 510. A cam 512 is disposed on the shaft 502 which has an outer surface 514 which varies in distance from a central axis A—A of the shaft 502. A portion of the outer surface 514*a* is in contact with the elongated strip 402 through opening 515*a*. The knob 508 is preferably accessible from a front of the paper tray 204 such that a user can easily access the knob 508 and rotate it, thus rotating the cam 512 about the shaft 502.

Retaining means retains the elongated strip 402 along a path B—B perpendicular to the top surface 206 of the paper tray 206. Preferably the retaining means comprises at least two shafts 516 perpendicular to the top surface 206 of the paper tray 204 (in other words, parallel to the movement of the elongated strip 402 along axis B—B). The shafts 516 have a first end 516*b* slidingly disposed in the top surface 206 of the paper tray 204 and a second end 516*a* disposed on the elongated strip 402. Preferably, the second end 516*a* of the shafts 516 are press fit or tack welded into corresponding openings in the elongated strip 402 and the first ends slide within corresponding holes on the top surface 206 of the paper tray 206. The first ends 516*b* also have a lip 516*c* for preventing the first ends 516*b* from coming free from their corresponding holes. Biasing means, such as a compression spring 518, are disposed around each shaft 516 for biasing the elongated strip 402 toward the top surface 206 of the paper tray 204 between the top surface 206 of the paper tray 204 and the lip 516*c* at the first ends 516*b* of the shafts 516.

The third embodiment of the curl eliminator 208 of the present invention also preferably includes a locking means for locking the elongated strip 402 at a predetermined height above the top surface 206 of the paper tray 204. The locking means preferably comprises a ball detent 602 disposed on the paper tray 204. The ball detent 602 generally has a threaded body which mates with a corresponding threaded hole in the paper tray 204. The ball detent 602 also has a ball 604 retained therein and biased towards the shaft 502 by a biasing means, such as a compression spring 606. A plurality of detents 608, which are preferably conical shaped cavities, are disposed around the circumference of the shaft 502.

The detents can be disposed on the shaft itself or alternatively, on a disk 610 retained on the shaft 502, preferably with a set screw or by press fitting. The ball 604 engages a corresponding detent 608*a* and is retained therein by the biasing force of the spring 606 thereby locking the elongated strip 402 at a height above the top surface 206 of the paper tray 204 corresponding to the circumferential location of the engaged detent 608*a* on the shaft 502.

Figure 6:
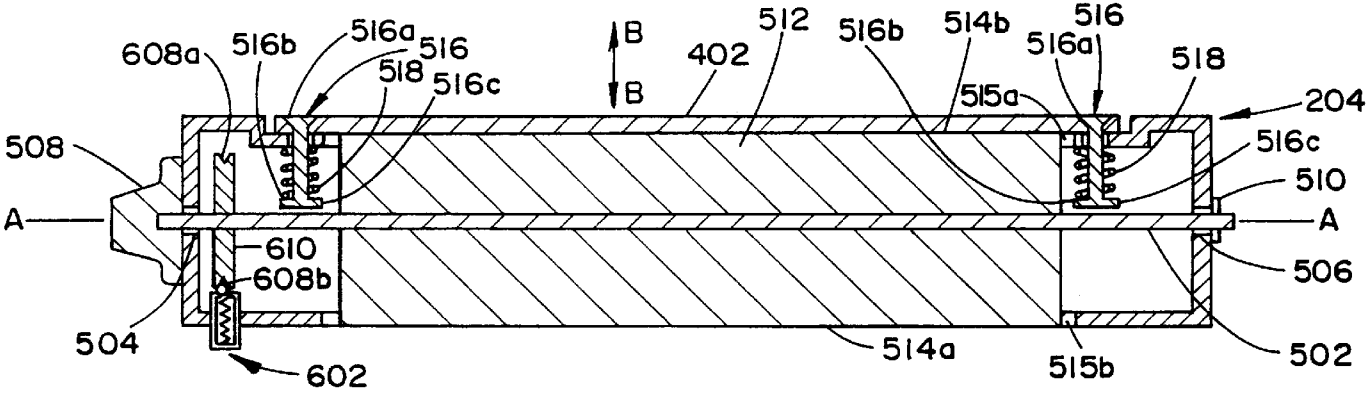
FIG. 6 is a sectional view of the curl eliminator of FIG. 4 as it would appear if taken along line 5—5 illustrating the elongated strip flush with the top surface of the paper tray.

It can be appreciated that as the knob 508, shaft 502, and cam 512 attached thereto are rotated towards detent 608*b* the weight of the elongated strip 402 and the biasing force of springs 518 will bring the elongated strip 402 into contact with the outer surface 514 of the cam 512. The elongated strip 402 is at its lowest height with respect to the top surface 206 of the paper tray 204 when the portion of the cam 514*b* faces the elongated strip 402, as shown in FIG. 6. In this position, portion 514*a* of the cam 512 will retreat into opening 515*b*. Preferably, the paper tray 204 includes a recess 612, so that the elongated strip 402 is flush with the top surface 206 of paper tray 204.

Obviously, the height of the elongated strip 402 above the top surface 206 of the paper tray 204 is variable depending upon the particular detent 608 engaged with the ball 604. The incremental amount that the height can be adjusted is dependent upon the number of detents 608 disposed about the circumference of the shaft 502, or alternatively, the disk 610.

In operation, the rotation of knob 508 results in the height of the elongated strip 402 above the top surface 206 of the paper tray 204 to increase or decrease depending on the distance from the central axis A—A of the shaft 502 to the portion of the outer surface 514*a* in contact with the elongated strip 402.

From the foregoing description, it can be appreciated by someone skilled in the art that the adjustment means can eliminate the curl from paper stacks with varying degrees of curl. If the paper stack 108 has a severe curl, the height of elongated strip 402 can be increased as described. Alternatively, if the paper stack 108 has a minor curl, the height of elongated strip 402 can be decreased. The simplicity, inexpensiveness, and ease of retrofitting existing printers with the curl eliminator 208 embodiments of the present invention can also be appreciated by an artisan skilled in the art.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

I claim:

1. A printer tray for eliminating a curl from paper to be printed by a printer, the printer having a paper feeder including the paper tray for storage of the paper on a top surface of the paper tray and for feeding the paper into the printer for subsequent printing, the printer tray comprising:

a curl eliminator having a heightened portion comprising an elongated strip disposed at the top surface of the paper tray such that it opposes the curl of the paper thereby tending to flatten the curl; and a mounting means for mounting the elongated strip to the top surface of the paper tray;

wherein the top surface of the paper tray is ferric and the mounting means is a magnetic strip fastened to the elongated strip whereby the elongated strip is mounted to the top surface of the paper tray by a magnetic attraction between the magnetic strip attached thereto and the top surface of the paper tray.

2. The printer tray according to claim 1, wherein the elongated strip is positioned substantially along a central axis of the paper, the central axis being parallel to a feeding direction of the paper.

3. The printer tray according to claim 2, wherein the elongated strip has a length substantially equal to the length of the paper, the length being measured in the direction that the paper is fed into the printer.

4. The printer tray according to claim 1, wherein the magnetic strip is fastened to the elongated strip with an adhesive.

5. A printer for eliminating a curl from paper to be printed, the printer comprising:

a paper feeder having a paper tray for storage of the paper on a top surface of the paper tray and for feeding the paper into the printer for subsequent printing;

a curl eliminator having a heightened portion comprising an elongated strip disposed at the top surface of the paper tray such that it opposes the curl of the paper thereby tending to flatten the curl and a mounting means for mounting the elongated strip to the top surface of the paper tray;

wherein the top surface of the paper tray is ferric and the mounting means is a magnetic strip fastened to the elongated strip whereby the elongated strip is mounted to the top surface of the paper tray by a magnetic attraction between the magnetic strip attached thereto and the top surface of the paper tray.

6. The printer according to claim 5, wherein the elongated strip is positioned substantially along a central axis of the paper, the central axis being parallel to a feeding direction of the paper.

7. The printer according to claim 6, wherein the elongated strip has a length substantially equal to the length of the paper, the length being measured in the direction that the paper is fed into the printer.

8. The printer according to claim 5, wherein the magnetic strip is fastened to the elongated strip with an adhesive.

9. A curl eliminator for eliminating a curl from paper to be printed by a printer, the printer having a paper feeder including a paper tray for storage of the paper on a top surface of the paper tray and for feeding the paper into the printer for subsequent printing, the curl eliminator comprising:

an elongated strip disposed at the top surface of the paper tray such that it opposes the curl of the paper thereby tending to flatten the curl; and a mounting means for mounting the elongated strip to the top surface of the paper tray;

wherein the top surface of the paper tray is ferric and the mounting means is a magnetic strip fastened to the elongated strip whereby the elongated strip is mounted to the top surface of the paper tray by a magnetic attraction between the magnetic strip attached thereto and the top surface of the paper tray.

10. The curl eliminator according to claim 9, wherein the elongated strip is positioned substantially along a central axis of the paper, the central axis being parallel to a feeding direction of the paper.

11. The curl eliminator according to claim 10, wherein the elongated strip has a length substantially equal to the length of the paper, the length being measured in the direction that the paper is fed into the printer.

12. The curl eliminator according to claim 9, wherein the magnetic strip is fastened to the elongated strip with an adhesive.

* * * * *